United States Patent [19]

Havel

[11] Patent Number: 4,707,141

[45] Date of Patent: Nov. 17, 1987

[54] VARIABLE COLOR ANALOG TIMEPIECE

[76] Inventor: Karel Havel, 15 Kensington Road, Apt. #704, Bramalea, On, Canada, L6T 3W2

[21] Appl. No.: 667

[22] Filed: Jan. 6, 1987

Related U.S. Application Data

[63] Continuation-in-part of Ser. No. 817,114, Jan. 8, 1986, Pat. No. 4,647,217.

[51] Int. Cl.[4] ..... G04B 47/06; G04C 19/00

[52] U.S. Cl. ..... 368/11; 368/82; 368/241; 340/701

[58] Field of Search ..... 368/10–12, 368/76, 80, 223, 228–234, 235; 340/701

[56] References Cited

U.S. PATENT DOCUMENTS

| | | | |
|---|---|---|---|
| 3,763,647 | 10/1973 | Shibanai | 368/235 |
| 3,922,847 | 2/1975 | Culley et al. | 58/50 |
| 3,969,887 | 5/1976 | Fukumoto | 58/50 |
| 4,451,157 | 5/1984 | Reap | 368/11 |

FOREIGN PATENT DOCUMENTS

| | | | |
|---|---|---|---|
| 2274966 | 1/1976 | France . | |
| 54-19788 | 2/1979 | Japan | 368/11 |

*Primary Examiner*—Vit W. Miska

[57] ABSTRACT

A timepiece includes a variable color display for providing an analog indication of time and a transducer for measuring values of a diverse quantity. The color of the analog indication may be controlled in a plurality of steps in accordance with the output of the transducer.

7 Claims, 9 Drawing Figures

VARIABLE COLOR ANALOG TIMEPIECE

CROSS-REFERENCE TO RELATED APPLICATIONS

This is a continuation-in-part of my copending application Ser. No. 06/817,114, filed on Jan. 8, 1986, entitled Variable Color Digital Timepiece, now U.S. Pat. No. 4,647,217 issued on Mar. 3, 1987.

BACKGROUND OF THE INVENTION

1. Field of the Invention

This invention relates to timepieces utilizing variable color analog display.

2. Description of the Prior Art

An electronic timepiece disclosed in U.S. Pat. No. 3,922,847, issued on Dec. 2, 1975 to Bobby Gene Culley et al, includes a time base oscillator, counters, and a display consisting of 12 monochromatic light emitting diodes arranged in an inner ring, for individually indicating hours, and 60 monochromatic light emitting diodes arranged in an outer ring, for alternatively indicating minutes and seconds.

A liquid crystal analog timepiece disclosed in U.S Pat. No. 3,969,887, issued on July 20, 1976 to Shigeru Fukumoto, includes a display having hour and minute information segment electrodes for indicating time in a conventional format.

Monochromatic analog display timepieces are not capable of simultaneously indicating values of time and values of a diverse quantity.

SUMMARY OF THE INVENTION

In a broad sense, it is the principal object of this invention to provide a timepiece with a variable color analog display.

It is another object of the invention to provide an analog timepiece in which the color of the display may be controlled in accordance with a diverse quantity.

In summary, electronic timepiece of the present invention is provided with a variable color display for providing an analog indication of time. The timepiece also includes a transducer for measuring a diverse quantity and for developing output electrical signals related to values of the measured quantity. Color control circuits are provided for controlling the color of the analog indication in accordance with the output electrical signals of the transducer.

BRIEF DESCRIPTION OF THE DRAWINGS

In the drawings in which are shown several embodiments of the invention.

Throughout the drawings, like characters indicate like parts.

DESCRIPTION OF THE PREFERRED EMBODIMENTS

Figure 1:
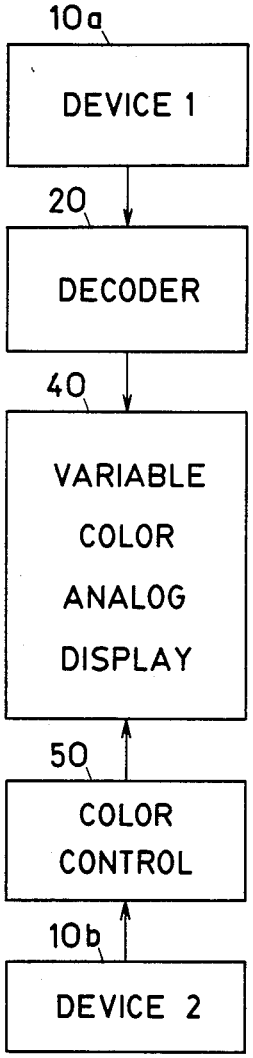
FIG. 1 is a block diagram of a variable color analog display system of the invention.

Referring now, more particularly, to the drawings, in FIG. 1 is shown a block diagram of an analog display system which includes a first device 10*a* for developing electrical signals, a suitable decoder 20 for converting the signals into a displayable analog indication, and a variable color analog display 40 for providing a visual analog indication of the signals. The invention resides in the addition of a color control circuit 50 for controlling the color of the analog indication in accordance with signals developed by a second device 10*b*. The variable color display system of the invention can thus simultaneously indicate values of two different quantities, from the outputs of devices 10*a* and 10*b*, by causing an analog indication representing the value of the first quantity to be exhibited on the display and by controlling the color of the indication in accordance with the value of the second quantity.

Figure 2:
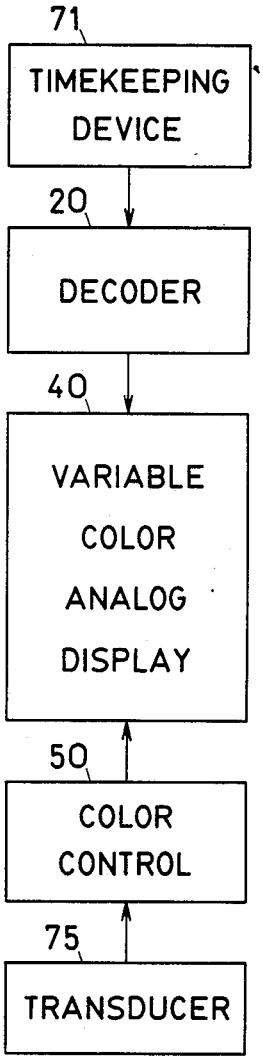
FIG. 2 is a block diagram of a variable color analog timepiece with transducer.

FIG. 2 is a generalized block diagram of an analog timepiece with transducer of this invention which includes a timekeeping device 71 for keeping time and for developing output electrical signals indicative of time, decoder 20 for converting the output electrical signals to a displayable indication, and variable color analog display 40 for exhibiting an analog indication of time. The invention resides in the addition of a transducer 75, for measuring a diverse quantity and for developing output signals related thereto, and color control 50, for controlling the color of the analog indication in accordance with the output signals of transducer 75. The display 40 will thus simultaneously indicate time, in analog format, and values of the measured diverse quantity, in variable color.

As will be more fully pointed out subsequently, the preferred embodiment of a timepiece of the invention utilizes a temperature transducer for measuring values of temperature and for developing output signals related thereto. Such timepiece is capable of simultaneously indicating time, by exhibiting an analog indication representing time, and temperature, by controlling the color of the analog indication in accordance with temperature.

Figure 3:
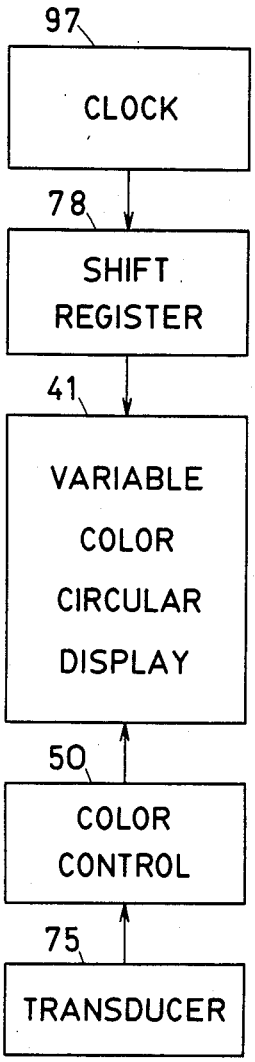
FIG. 3 is a block diagram of a like timepiece characterized by a variable color circular display.

In FIG. 3 is shown a block diagram of a like timepiece characterized by a clock pulse source 97 for furnishing a train of stable clock pulses, a shift register 78 for shifting predetermined data in accordance with the clock pulses, and variable color analog display 40 coupled to the shift register for exhibiting the data visually. The overall effect is a timepiece face that simulates the appearance of an hour and minute hands to present time information in substantially conventional manner.

The term transducer, as used throughout the description of the invention, is used in its widest sense so as to include every type of a device for performing a conversion of one type of energy to another. The principles of the invention may be applied to various displacement, motion, force, pressure, sound, flow; temperature, humidity, weight, magnetic, physiological, and like transducers. A physical transducer is defined for the purpose of this invention as means for measuring values of a physical quantity and for developing output electrical signals related thereto. A physiological transducer is defined as means for producing electrical signals which represent physiological conditions or events in a human body or other living matter.

Figure 4:
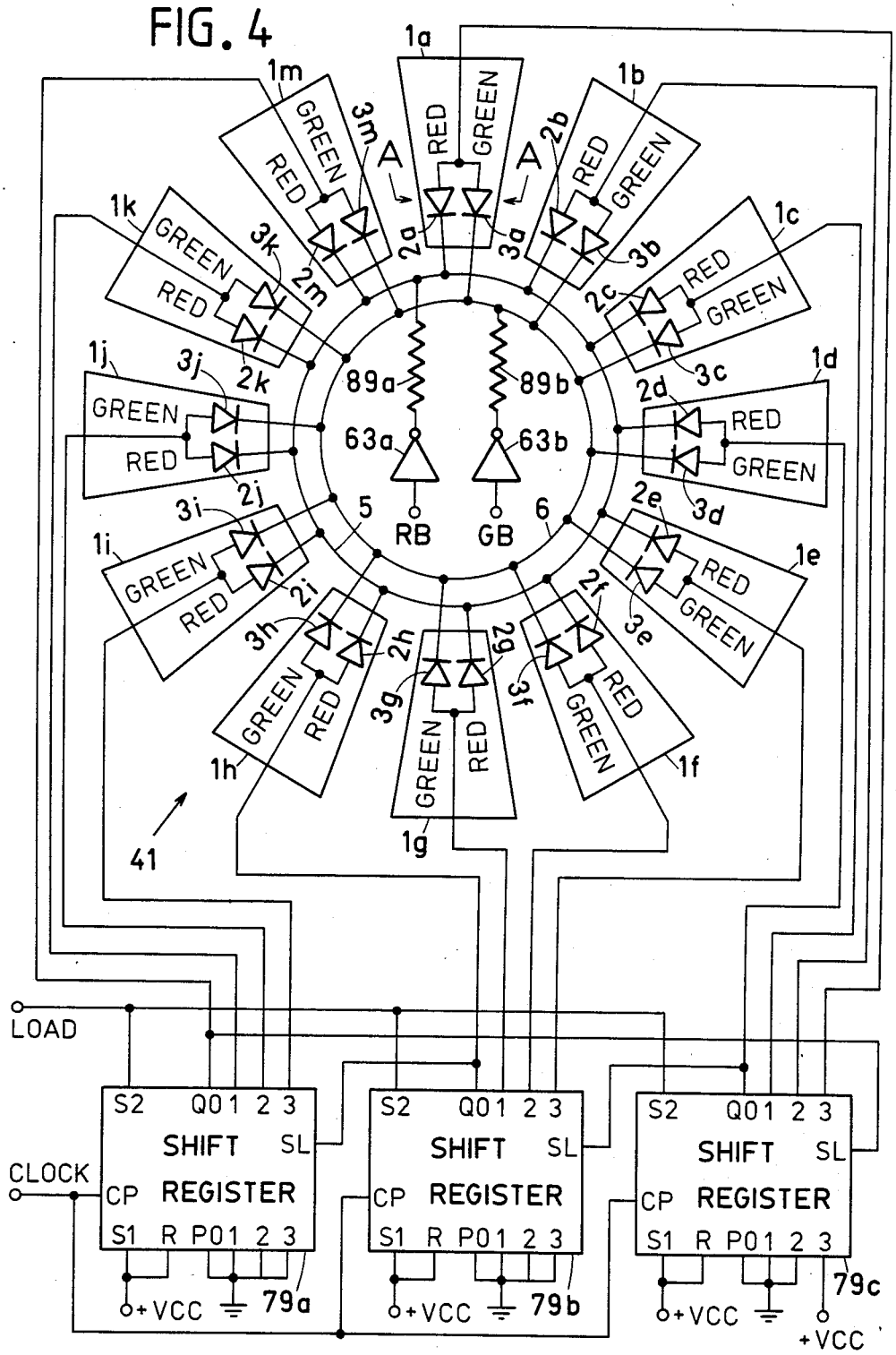
FIG. 4 is a schematic diagram of a variable color analog timepiece.

In FIG. 4 is shown a schematic diagram of a variable color analog timepiece. The circular display designated 41 includes twelve variable color display segments 1*a*, 1*b*, 1*c*, 1*d*, 1*e*, 1*f*, 1*g*, 1*h*, 1*i*, 1*j*, 1*k*, and 1*m*, regularly spaced along a circle to resemble a conventional timepiece face, which may be progressively energized to exhibit analog indication of time. Each display segment includes a pair of LEDs (light emitting diodes): a red LED 2 and greed LED 3, which are closely adjacent such that the light signals emitted therefrom are substantially superimposed upon each other to mix the colors. To facilitate the illustration, the LEDs are designated by segment symbols, e.g., the red LED in the segment 1*a* is designated as 2*a*, etc. The anodes of all red and green LED pairs are interconnected in each display segment and are electrically connected to respective outputs of commercially well known shift registers 79*a*, 79*b*, and 79*c*. The cathodes of all red LEDs 2*a*, 2*b*, 2*c*, 2*d*, 2*e*, 2*f*, 2*g*, 2*h*, 2*i*, 2*j*, 2*k*, and 2*m* are commonly coupled to an electric path referred to as a red bus 5. The cathodes of all green LEDs 3*a*, 3*b*, 3*c*, 3*d*, 3*e*, 3*f*, 3*g*, 3*h*, 3*i*, 3*j*, 3*k*, and 3*m* are commonly coupled to a like electric path referred to as a green bus 6.

The red bus 5 is connected via a current limiting resistor 89*a* to the output of an inverting buffer 63*a*. The green bus 6 is connected via a current limiting resistor 89b to the output of a like buffer 63*b*. The conditions of the red and green buses can be selectively controlled by applying suitable logic control signals to the bus inputs RB (red bus) and GB (green bus).

The display 41 is controlled by chain of shift registers 79*a*, 79*b*, and 79*c* adapted for shifting data to the left by having their Shift Left inputs SL respectively coupled to outputs of the next one of the shift registers and by having their select inputs S1 coupled to a high logic level, in a manner well understood by those skilled in the art. The parallel inputs P0, P1, P2, and P3 of all shift registers are coupled to a low logic level except for the most significant input P3 of shift register 79*c* which is coupled to a high logic level. When a short positive pulse LOAD is applied to the interconnected select inputs S2, the data from the parallel inputs are loaded into the shift registers, appear at their outputs Q0, Q1, Q2, and Q3, and may be progressively shifted to the left with each active clock transition when the inputs S2 are returned to a low logic level. A high logic level at a particular output Q of the shift registers will forwardly bias one or both LEDs in the associated display segments, depending on the conditions of the bus control inputs RB and GB.

Figure 5:
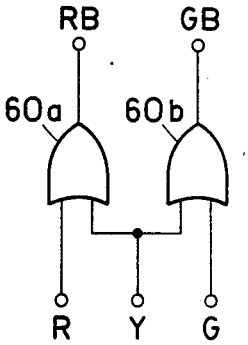
FIG. 5 is a schematic diagram of a color control converter.

In FIG. 5 is shown a schematic diagram of a color control converter circuit which includes OR gates 60*a* and 60*b* for gating color control logic signals R (red), Y (yellow), and G (green) applied to their inputs to develop bus control signals RB (red bus) and GB (green bus) in a manner which will become clearer subsequently. The outputs RB and GB may be directly coupled to like inputs shown in FIG. 4.

Returning again to FIG. 4, the operation of the timepiece will be explained on example of illuminating display segment 1*a* in three different colors. It is assumed for the purpose of the description that the outputs RB and GB of the color control converter in FIG. 5 are coupled to like inputs in FIG. 4. The display segment 1*a* may be illuminated when the output Q3 of shift register 79*c* rises to a high logic level. To illuminate the segment 1*a* in red color, the color control input R is raised to a high logic level and color control inputs Y and G are maintained at a low logic level. As a result, the output of OR gate 60*a* rises to a high logic level, thereby forcing the output of buffer 63*a* to drop to a low logic level. The current flows from the output Q3 of shift register 79*c* via red LED 2*a*, red bus 5, and resistor 89*a* to the current sinking output of buffer 63*a*. As a result, segment 1*a* illuminates in red color. The green LED 3*a* remains extinguished because the output of buffer 63*b* is at a high logic level, thereby disabling the green bus 6.

To illuminate the segment 1*a* in green color, the color control input G is raised to a high logic level, while the color control inputs R and Y are maintained at a low logic level. As a result, the output of OR gate 60*b* rises to a high logic level, thereby forcing the output of buffer 63*b* to drop to a low logic level. The current flows from the output Q3 of shift register 79*c* via green LED 3*a*, green bus 6, and resistor 89*b* to the current sinking output of buffer 63*b*. As a result, segment 1*a* illuminates in green color. The red LED 2*a* remains extinguished because the output of buffer 63*a* is at a high logic level, thereby disabling the red bus 5.

To illuminate the segment 1*a* in yellow color, the color control input Y is raised to a high logic level, while the color control inputs R and G are maintained at a low logic level. As a result, the outputs of both OR gates 60*a* and 60*b* rise to a high logic level, thereby forcing the outputs of both buffers 63*a* and 63*b* to drop to a low logic level. The current flows from the output Q3 of shift register 79*c* via red LED 2*a*, red bus 5, and resistor 89a to the output of buffer 63*a* and via green LED 3*a*, green bus 6 and resistor 89*b* to the output of buffer 63*b*. As a result of internally blending light of red and green colors, segment 1*a* illuminates in substantially yellow color.

Figure 6:
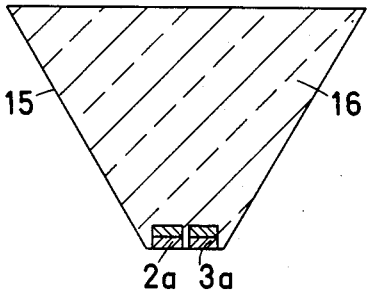
FIG. 6 is an enlarged cross-sectional view of one display segment in FIG. 4, taken along the line A—A.

In FIG. 6, red LED 2*a* and green LED 3*a* are placed on the base of a segment body 15 which is filled with a transparent light scattering material 16. When forwardly biased, the LEDs 2*a* and 3*a* emit light signals of red and green colors, respectively, which are scattered within the transparent material 16, thereby blending the red and green light signals into a composite light signal that emerges at the upper surface of the segment body 15. The color of the composite light signal may be controlled by varying portions of the red and green light signals.

Figure 7:
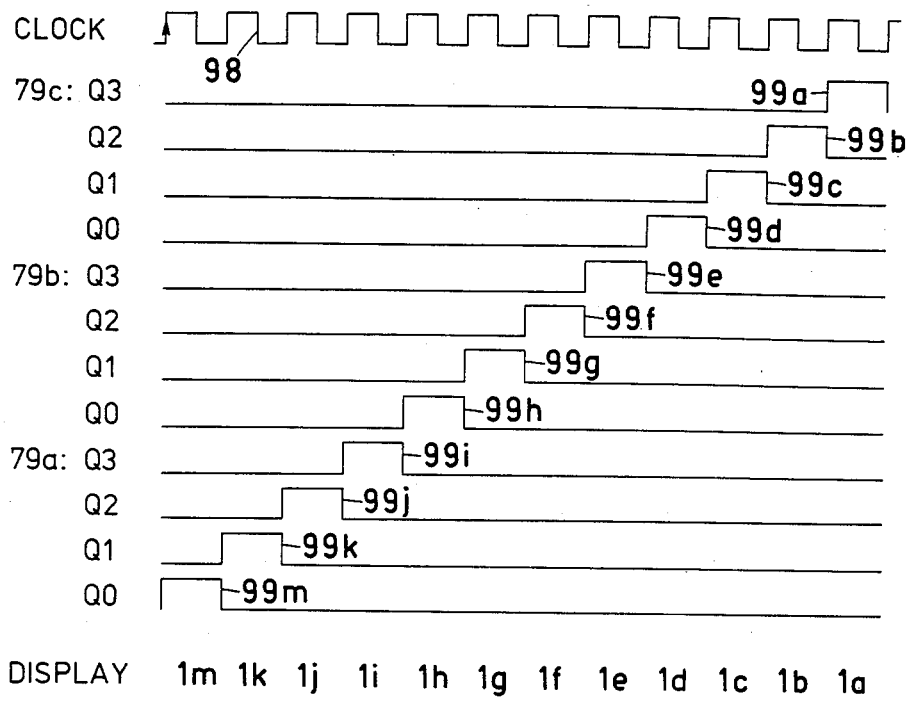
FIG. 7 is a timing diagram showing the timing relationship of output signals in shift register chain in FIG. 4.

In FIG. 7 is shown a timing diagram of the output signals in the shift register chain in FIG. 4. Clock pulses 98 are applied to the interconnected Clock Pulse inputs CP of the shift registers to serially shift their contents to the left with each low-to-high clock transition. Initially, the output Q3 of shift register 79*c* is at a high level, while all other Q outputs are low, for causing the associated display segment 1*a* to illuminate. When the high level is shifted to the output Q2 of the same shift register, display segment 1*b* illuminates. When the high level is shifted to the output Q1 of the same shift register, display segment 1*c* illuminates, etc.

It is readily apparent that the rate of movement of the analog indication on the display depends on the period of the clock. When the clock period is 1 hour, the display indicates one of 12 hours. When the clock period is 5 minutes, the display indicates time to the nearest 5 minutes. When the clock period is 5 seconds, the display similarly indicates time to the nearest 5 seconds. It would be obvious to add additional display segments and shift registers to provide more accurate time indication.

Figure 8:
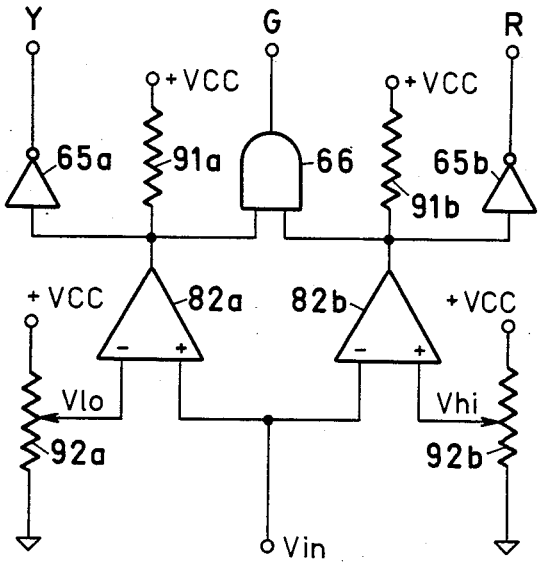
FIG. 8 is a schematic diagram of a signal converter for developing color control signals.

In FIG. 8 is shown a schematic diagram of an exemplary signal converter which converts values of analog voltage to color control logic signals R, Y, and G for controlling the color of the display segments in FIG. 4 in accordance with the magnitude of input voltage. An analog voltage Vin is applied to the interconnected inputs of two analog comparators 82*a* and 82*b*, in a classic 'window' comparator configuration. When the voltage Vin is lower than the low voltage limit Vlo, set by a potentiometer 92*a*, the output of comparator 82*a* drops to a low logic level, thereby forcing the output of inverter 65*a* to rise to a high logic level to generate active color control signal Y for illuminating the segment in yellow color.

When the voltage Vin is higher than the high voltage limit Vhi, set by a potentiometer 92*b*, the output of comparator 82*b* drops to a low logic level, thereby forcing the output of inverter 65*b* to rise to a high logic level to generate active color control signal R for illuminating the segment in red color.

When the voltage Vin is between the low voltage limit Vlo and high voltage limit Vhi, the outputs of comparators 82*a*, 82*b* rise to a high logic level, thereby causing the output of AND gate 66 to rise to a high logic level to generate active color control signal G for illuminating the segment in green color.

The outputs R, Y, and G may be directly coupled to like inputs of the color control converter in FIG. 5. It would be obvious that the color sequences could be readily changed by differently interconnecting the outputs of the signal converter with color control inputs of the color control converter.

Figure 9:
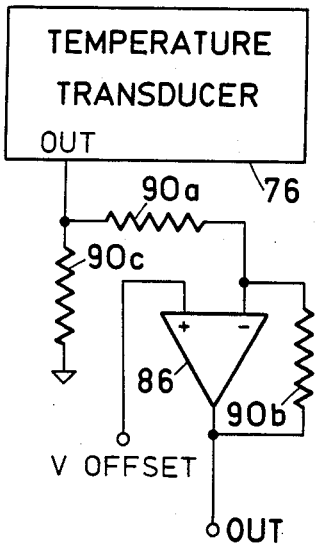
FIG. 9 is a schematic diagram of a temperature transducer with interface circuit.

In a schematic diagram shown in FIG. 9, temperature transducer 76 measures ambient temperature and develops at its output a current which is linearly proportional to measured temperature in degrees Kelvin. The current flows through a resistor 90*c* of suitable value (e. g., 1 k Ohm) to ground, to develop voltage proportional to the measured temperature, which is applied to the input of an op amp 86 having a feedback established by resistors 90*a* and 90*b*. To read at the op amp's output OUT voltage that directly corresponds to temperature in degrees Celsius, a DC voltage 273.2 mV is applied to the other input V OFFSET. The invention resides in utilizing the output voltage at the terminal OUT to develop color control signals for causing the timepiece display to illuminate in a color related to measured ambient temperature. To achieve this, the terminal OUT may be connected to the input Vin of the signal converter in FIG. 8 to control the color of the timepiece display in three steps.

Although not shown in the drawings, it will be appreciated that the timepiece of this invention may have any conceivable form or shape, such as a wrist watch, pocket watch, clock, alarm clock, and the like. Alternatively, the timepiece may have characteristics of an article for wearing on a body of wearer or for securing to wearer's clothing, such as a bracelet, ring, ear-ring, necklace, tie tack, button, cuff link, brooch, hair ornament, and the like, or it may be built into, or associated with, an object such as a pen, pencil, ruler, lighter, briefcase, purse, and the like.

In brief summary, the invention describes a method of simultaneously displaying values of time and values of a diverse quantity, on a single variable color display device, by causing an analog indication representing time to be indicated on the display device, and by controlling the color of the indication in accordance with the values of the diverse quantity.

A timepiece with a variable color analog display for providing an analog indication of time was disclosed which also includes a transducer for measuring values of a diverse quantity, such as temperature. Color control responsive to output signals of the transducer is provided for controlling the color of the analog indication in accordance with measured values of the diverse quantity.

All matter herein described and illustrated in the accompanying drawings should be interpreted as illustrative and not in a limiting sense. It would be obvious that numerous modifications can be made in the construction of the preferred embodiments shown herein, without departing from the spirit of the invention as defined in the appended claims. It is contemplated that the principles of the invention may be also applied to numerous diverse types of display devices, such are liquid crystal, plasma devices, and the like.

CORRELATION TABLE

This is a correlation table of reference characters used in the drawings herein, their descriptions, and examples of commercially available parts.

| # | DESCRIPTION | EXAMPLE |
|---|---|---|
| 1 | display element | |
| 2 | red LED | |
| 3 | greed LED | |
| 5 | red bus | |
| 6 | green bus | |
| 10 | device developing electrical signals | |
| 15 | segment body | |
| 16 | light scattering material | |
| 20 | decoder | |
| 40 | variable color analog display | |
| 41 | variable color circular display | |
| 50 | color control | |
| 60 | 2-input OR gate | 74HC32 |
| 63 | inverting buffer | 74LS240 |
| 65 | inverter | 74HC04 |
| 66 | 2-input AND gate | 74HC08 |
| 71 | timekeeping device | |
| 75 | transducer | |
| 76 | Analog Devices temperature transducer | AD590J |
| 78 | shift register | |
| 79 | 4-bit shift register | 74LS194 |
| 82 | analog comparator | LM339 |
| 86 | op amp | LM741 |
| 89 | resistor | |
| 90 | resistor | |
| 91 | resistor | |
| 92 | potentiometer | |
| 97 | clock pulse source | |
| 98 | clock pulse | |
| 99 | pulse | |

What I claim is:

1. A timepiece comprising:

timekeeping means;

variable color analog display means for providing an analog indication of time;

means for measuring a diverse quantity and for developing output signals related thereto; and color control means responsive to said output signals for controlling the color of said indication in accordance with said diverse quantity.

2. A timepiece as defined in claim 1 wherein said color control means controls the color of said indication in three steps.

3. A timepiece as defined in claim 1 more characterized by:

comparator means for effecting a comparison of said output signals with a low and high predetermined limits to determine whether measured value of said diverse quantity is lower than said low predetermined limit, or higher than said high predetermined limit, or within the bounds of said low and high predetermined limits, and for developing comparison signals accordingly; and said color control means illuminating said indication in a first color when the measured value of said diverse quantity is lower than said low predetermined limit, in a second color when the measured value of said diverse quantity is higher than said high predetermined limit, and in a third color when the measured value of said diverse quantity is within the bounds of said low and high predetermined limits, said first, second, and third colors being respectively different.

4. A timepiece comprising:

timekeeping means;

variable color analog display means for providing an analog indication of time;

temperature transducer means for measuring temperature and for developing output electrical signals related thereto; and color control means responsive to said output electrical signals for controlling the color of said indication in accordance with the values of temperature.

5. A timepiece as defined in claim 4 more characterized by:

comparator means for effecting a comparison of measured value of temperature with a low and high predetermined limits to determine whether the measured value of temperature is lower than said low predetermined limit, or higher than said high predetermined limit, or within the bounds of said low and high predetermined limits, and for developing comparison signals accordingly; and said color control means being responsive to said comparison signals for illuminating said indication in a first color when the measured value of temperature is lower than said low predetermined limit, in a second color when the measured value of temperature is higher than said high predetermined limit, and in a third color when the measured value of temperature is within the bounds of said low and high predetermined limits, said first, second, and third colors being respectively different.

6. A timepiece comprising:

timekeeping means;

variable color analog display means for providing an analog indication of time;

means for measuring a diverse quantity and for developing output signals related thereto;

comparator means for effecting a comparison of said output signals with predetermined limits, to determine the range in which the measured value of said diverse quantity lies, and for developing comparison signals accordingly; and color control means responsive to said comparison signals for controlling the color of said indication in accordance with the range in which the measured value of said divrse quantity lies.

7. A timepiece comprising:

timekeeping means;

variable color analog display means for providing an analog indication of time;

temperature transducer means for measuring temperature and for developing output electrical signals related thereto;

comparator means for effecting a comparison of said output electrical signals with predetermined limits, to determine the range in which the measured value of temperature lies, and for developing comparison signals accordingly; and color control means responsive to said comparison signals for controlling the color of said indication in accordance with the range in which the measured value of temperature lies.

* * * * *